US007453034B2

(12) United States Patent
Johnson

(10) Patent No.: US 7,453,034 B2
(45) Date of Patent: Nov. 18, 2008

(54) PROTECTIVE AND DECORATIVE COVER FOR A GUITAR

(76) Inventor: Robert W Johnson, 225 W. Godfrey Ave., Philadelphia, PA (US) 19120

( * ) Notice: Subject to any disclaimer, the term of this patent is extended or adjusted under 35 U.S.C. 154(b) by 0 days.

(21) Appl. No.: 11/737,099

(22) Filed: Apr. 18, 2007

(65) Prior Publication Data

US 2007/0256535 A1 Nov. 8, 2007

Related U.S. Application Data

(60) Provisional application No. 60/797,305, filed on May 3, 2006.

(51) Int. Cl.
*G10D 3/00* (2006.01)

(52) U.S. Cl. ..... 84/329

(58) Field of Classification Search ..... 84/290, 84/327, 329

See application file for complete search history.

(56) References Cited

U.S. PATENT DOCUMENTS 3,309,954 A 3/1967 Phillips et al.
4,000,678 A 1/1977 Messina
4,177,847 A * 12/1979 Spindler ..... 150/162
D278,442 S 4/1985 Whomsley
5,725,094 A * 3/1998 Moral ..... 206/314
D400,561 S * 11/1998 Vargas-Phillips ..... D17/20
6,054,642 A * 4/2000 Brooks ..... 84/267
6,410,834 B1 * 6/2002 Hearfield ..... 84/453
6,649,817 B2 11/2003 Hartill

* cited by examiner

*Primary Examiner*—Kimberly R Lockett
(74) *Attorney, Agent, or Firm*—QuickPatents, Inc.; Kevin Prince

(57) ABSTRACT

A protective cover for an electric string instrument including a generally U-shaped cradle having a flexible front member connected to a flexible back member by a flexible edge member. An upper fin-engaging portion of the edge member can be adapted to fit over the upper fin of the electric string instrument. A flexible loop can be attached to the back member and adapted to fit over a lower fin on the instrument to hold the generally U-shaped cradle to it. An upper fin-engaging portion of the edge member can fit over the upper fin of the electric string instrument. A flexible loop can be attached to the back member and adapted to fit over the instrument's lower fin to hold the generally U-shaped cradle to it. The flexible edge member can also include at least one strap button opening to fit over any strap buttons located along the peripheral edge the instrument. A pick guard can be fixed to the front side of the instrument. A back plate can be fixed to the back side of the instrument.

20 Claims, 10 Drawing Sheets

PROTECTIVE AND DECORATIVE COVER FOR A GUITAR

CROSS-REFERENCE TO RELATED APPLICATIONS

This application claims the benefit of U.S. Provisional Patent Application 60/797,305, filed on May 3, 2006.

STATEMENT REGARDING FEDERALLY SPONSORED RESEARCH AND DEVELOPMENT

Not Applicable.

FIELD OF THE INVENTION

This invention relates to protective covers, and more particularly to a protective and decorative cover for electrical string instruments such as electrical guitars and basses.

DISCUSSION OF RELATED ART

Musical instruments such as electric guitars and electric basses are generally played with the musician standing and the back of the instrument held against the musician's body. Relative movement between the instrument and the musician's body causes marring of the often attractive and expensive finish of the instrument. This is especially true for electric guitars, use of which tends to be more dramatic and movement oriented than that of classical or acoustic guitars, in keeping with the type of music for which the electric instruments are best suited.

The body of stringed musical instruments during normal usage, or during the transportation of such instruments, is susceptible to scratches, cracks, dents, wear and other damage. Such damage can reduce the useful lifetime of the instruments, reduce playability and adversely affect the aesthetic qualities and tonal qualities as well.

The current state of electric guitar customization involves painting or cutting into the body of the instrument. This process is usually expensive and almost always leaves the owners little option if at some point in the future they change their mind about the alteration. Decals have also been used but they can sometimes be difficult to remove and leave adhesive on the body of the instrument, which could potentially lower its value.

Therefore, there is a need for an improved protective and decorative cover to aid in "non-destruction" electric string instrument customization and ornamentation. Further, such protective cover would provide the user the ability to display designs, patterns, symbols and other objects of a decorative and expressive nature on the instrument without damaging or altering the body of the electric string instrument itself. Such a protective cover can be accomplished by crating a removable vest which bears said decorative and expressive objects. Further, such protection should be easily removable and versatile in appearance thus offering the user an array of inexpensive and convenient customization options. Moreover, such a protective cover should be form-fitting in that it does not conceal the shape of the instrument but accentuates its outline and at the same time without interfering the playability of the electric string instrument. The present invention accomplishes these objectives.

SUMMARY OF THE INVENTION

The present invention is a protective cover for an electric string instrument such as an electric guitar provided in a vest-like form (which can also be referred to as a "Vesitar") that can be accomplished by creating a form fitting, removable covering, which can be made of an elastic lycra, leather or other form fitting materials. The protective cover can bear decorative or expressive objects.

In the preferred embodiment, the protective cover includes a generally U-shaped cradle having a flexible front member connected to a flexible back member by a flexible edge member. An upper fin-engaging portion of the edge member can be adapted to fit over the upper fin of the electric string instrument. A flexible loop can be attached to the back member and adapted to fit over the lower fin of the instrument to hold the generally U-shaped cradle to the instrument.

In accordance with other features of the present invention, the flexible edge member can also include at least one strap button opening which fits over strap buttons typically found along the peripheral edge an electric string instrument. A pick guard can be fixed to the front side of the instrument with pick guard screws for retaining the cover onto the instrument. The protective cover can also incorporate a back plate fixed to the back side of the instrument with back plate screws traversing the back plate engagement portion to retain the cover onto the instrument.

During use and installation, the top fin sleeve can be fitted over the top fin of the guitar. The vest is then pulled to the rear of the instrument where protective cover's strap button opening fits over the strap button. The material of the lower front portion of the protective cover can be pulled tight behind the pick guard and the pick guard screws are fastened. Back plate screws can be removed and material from lower posterior portion of the protective cover is pulled tight between the back plate and the body and the back plate screws can be tightened. The lower portion strip of the protective cover can then be pulled down across the rear of the instrument and loops around the lower fin and fastens on the posterior side of the instrument retaining the cover onto the guitar.

The present invention facilitates for its user the ability to display designs, patterns, symbols and other objects of a decorative nature on an electric string instrument such as an electric guitar or bass without damaging or altering its body. Furthermore, it is easily removable and can be versatile in appearance. The protective cover is attractive because it attaches onto the body of an electric string instrument in a manner outlining the shape of the instrument.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
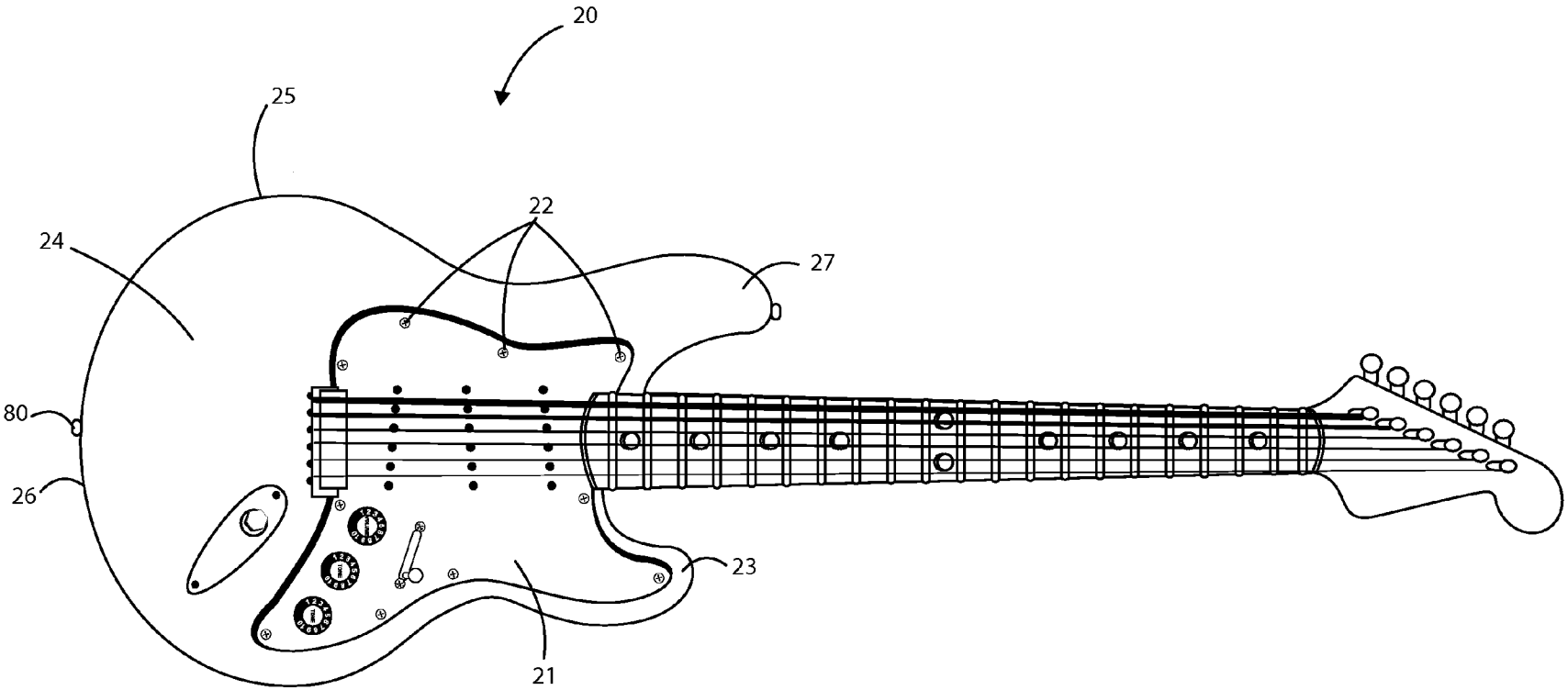
Fig. 1 (Prior Art)
FIG. 1, labeled as "prior art", illustrates a front plan view of a typical electric guitar, including a neck, body, top fin and lower fin, and which can benefit from the use of the unique features of the present invention.

Referring to FIG. 1, labeled as "prior art", illustrated is a front view of a typical electric guitar 20, which can be used for and benefit from features of the present invention. Although an electric guitar 20 is what is being illustrated, it should be appreciated that the electric guitar 20 is only being presented as an example of an electric string instrument that can benefit from use of the present invention, but is not meant to be a limitation over the invention. Other electric string instruments, such as electric basses, can also benefit from the features described herein. An electric guitar body 25 typically has an upper fin 27 on its upper right hand side and a lower fin 23 on its lower right hand side. The front side 24 of the guitar 20 typically includes a pick guard 21. The pick guard 21 can be attached to the front side 24 of the guitar 20 by as many as eight to eleven visible screws, which can be referred to as pick guard screws 22. An electric guitar 20 can also includes strap buttons 80 attached to a peripheral edge 26 of the body 25 of the guitar 20 for retaining a shoulder strap (not shown) onto the guitar 20 to facilitate user retention and control over the guitar 20.

Figure 2:
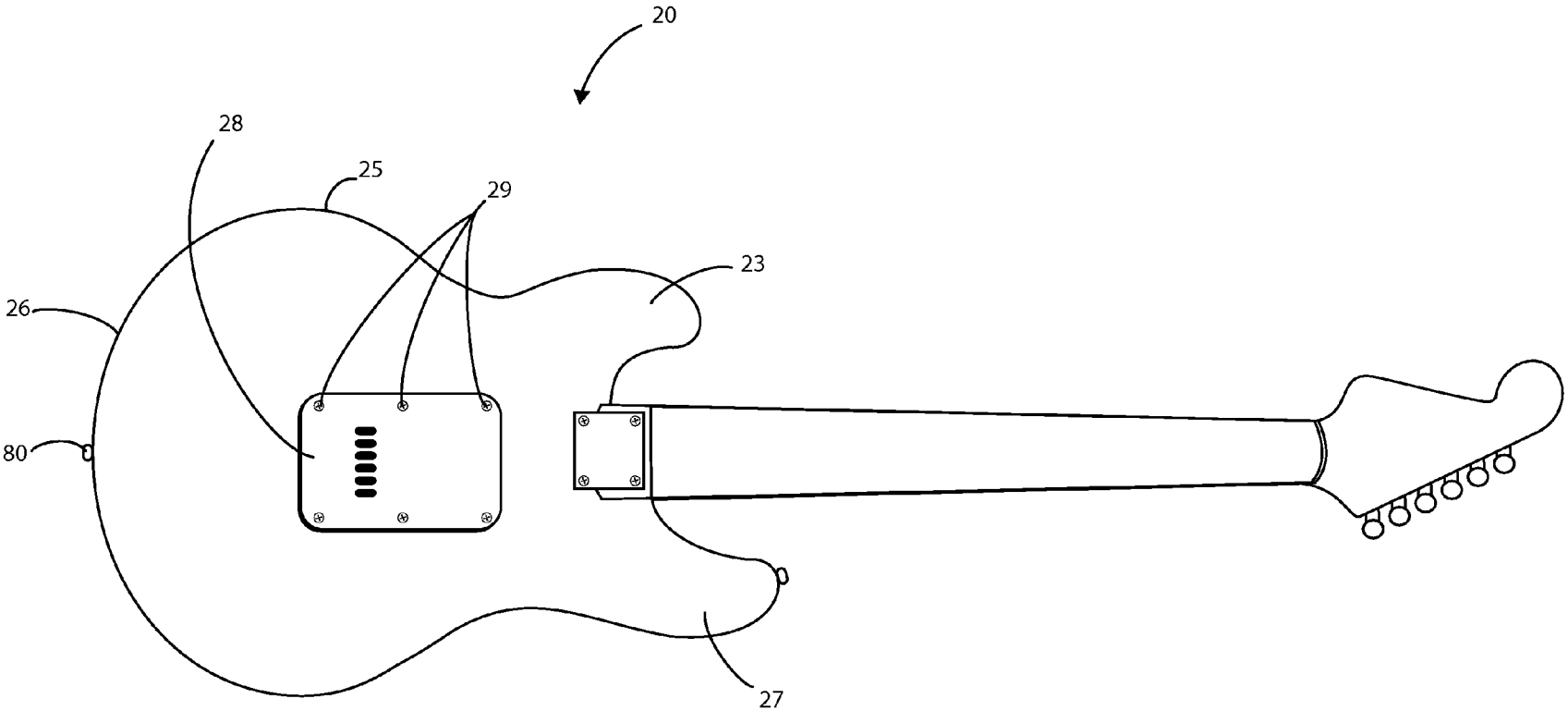
Fig. 2 (Prior Art)
FIG. 2, labeled as "prior art", illustrates a back plan view of the typical electric guitar illustrated in FIG. 1.

Referring to FIG. 2, also labeled as "prior art", a back side 23 of the electrical guitar 20 is illustrated and includes a back plate 28 with back plate screws 29 securing the back plate onto the back side 23 of the guitar 20. Strap buttons 80 are again shown attached to the peripheral edge 26 the body 25 to retain a shoulder strap (not shown) onto the guitar 20.

Figure 3:
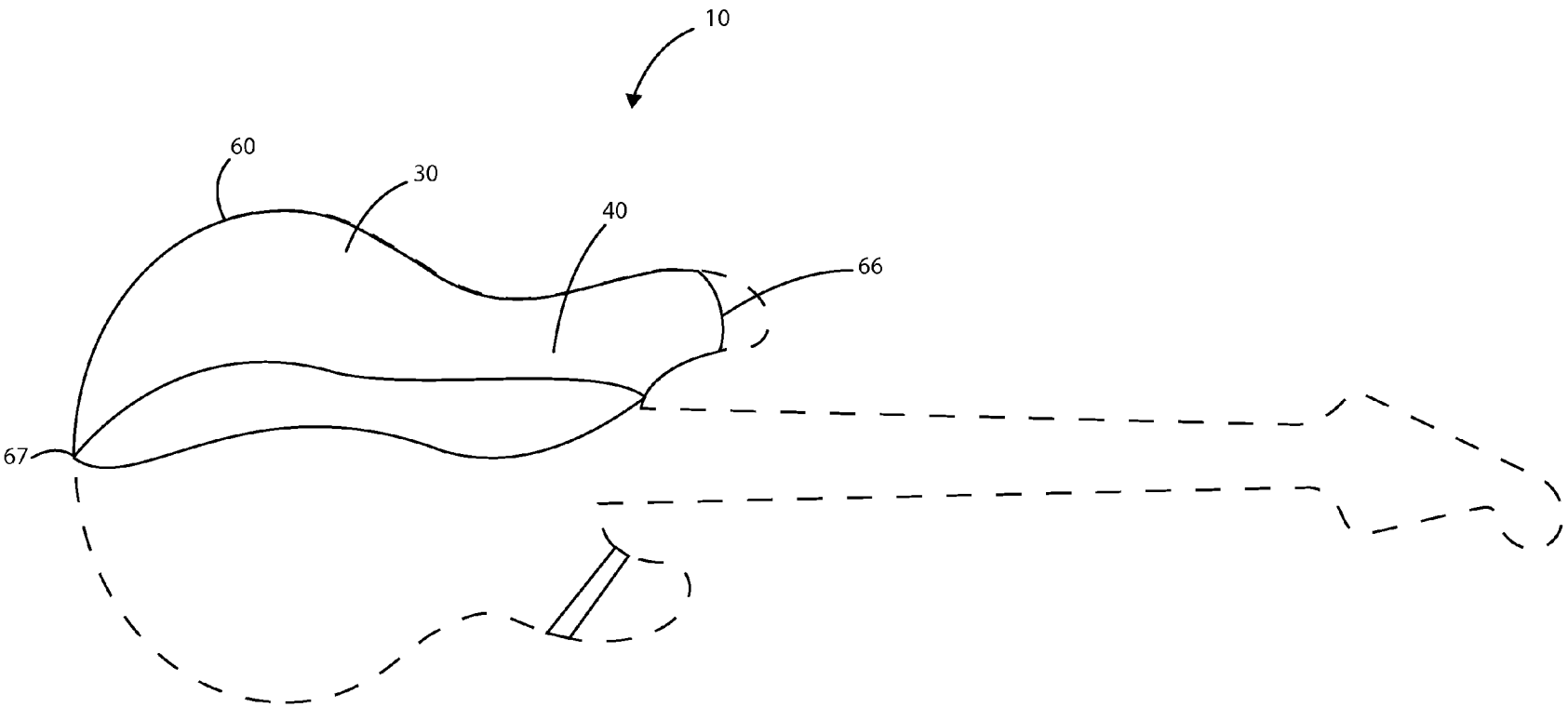
FIG. 3 illustrates a front view of the guitar in FIG. 1 including a protective cover in accordance with feature of the present invention, the protective cover stretched over the guitar's body and including a U-shaped cradle, front member, side member, fin aperture and flexible loop.

Referring to FIG. 3, the front side of a guitar like as described with reference to FIG. 1 is illustrated. A protective cover 10 in accordance with the preferred embodiment is generally shown covering a portion of the guitar's body. The protective cover 10 can be made of form-fitting materials such as nylon lycra, leather and similar material with renowned properties of elasticity, the ability to be form-fitting and affordable. The protective cover 10 includes a generally U-shaped cradle 30 having a flexible front member 40 connected to a flexible back member 50 (not shown) by a flexible edge member 60 having an upper fin-engaging portion 65 (not shown) with a fin aperture 66 for fitting over the upper fin 27 of the guitar. The flexible loop 70 attached to the back member 50 can be fitted over the lower fin 23 of the guitar 20 to hold the generally U-shaped cradle 30 onto the guitar 20. The protective cover 10 can further include at least one aperture 67 for receiving a strap button 80 mounted on the peripheral edge of the guitar 20.

Figure 4:
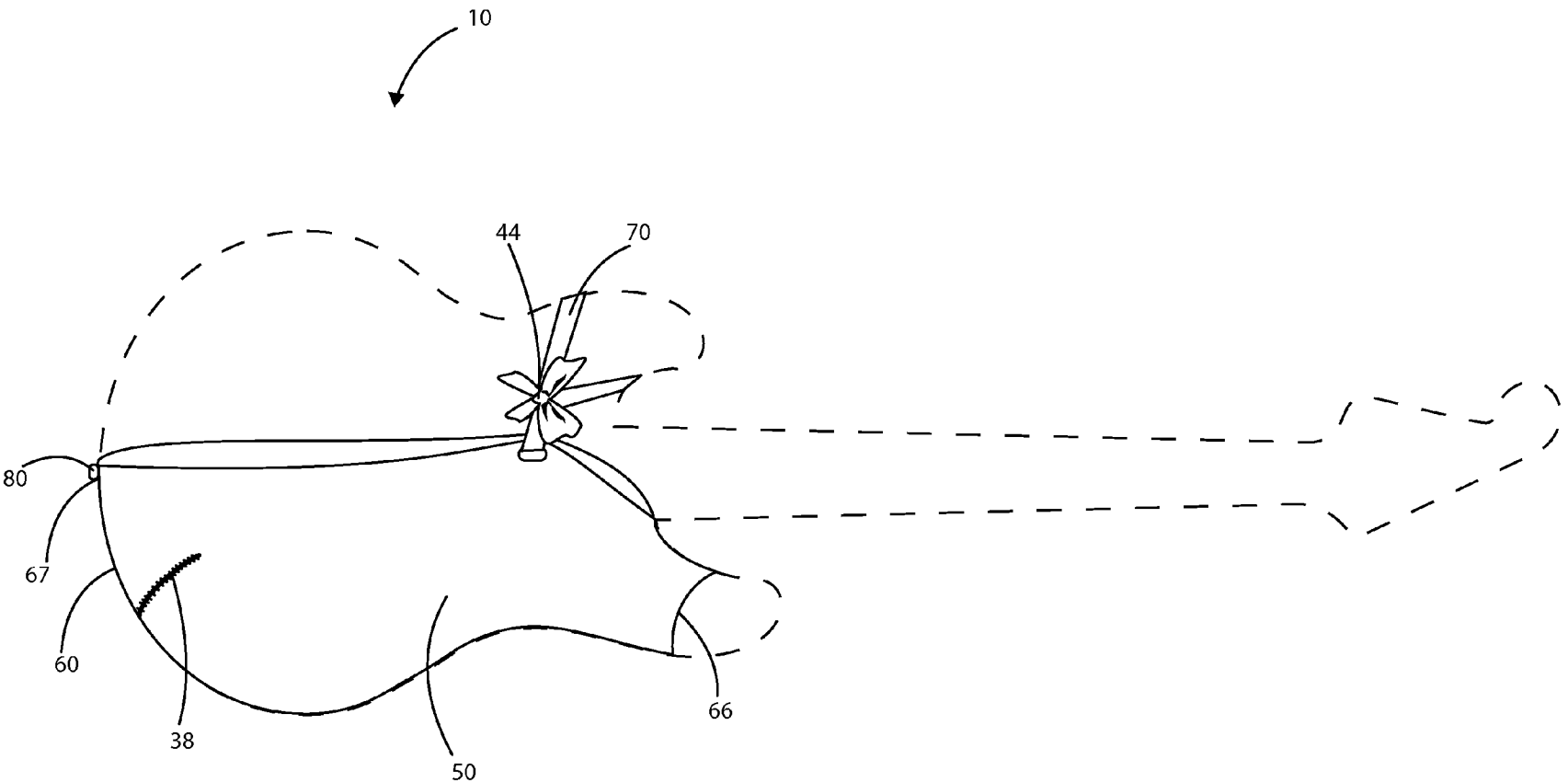
FIG. 4 illustrates a back view of the guitar as shown in FIG. 3 including the protective cover and including a back member, flexible loop, loop fastener, and posterior seam.

Referring to FIG. 4, a back view of the guitar shown in FIG. 2 is shown with a protective cover 10 located thereon. The flexible back member 50 can be connected to flexible edge member 60 and also include an aperture 67 for receiving a strap button 80 and further retain the cover onto the guitar 20. The flexible loop 70 can be pulled down across the rear side of the guitar and can be fastened 44—e.g., with a tie rope as illustrated, or with snaps or hook-and-loop type fasteners (not shown)—to the back member 60 at the back side of the guitar 20. The cover 10 further includes a fin aperture 66 therein such that the upper fin 27 of the guitar 20 can project through the fin aperture 66 and be held snuggly within the fin aperture 66. A rear seam 38 shown on the back member 50 can provide additional formability or flexibility of the cover 10. The exact measurements of the cover can vary in order to accommodate various string instrument models.

Figure 5:
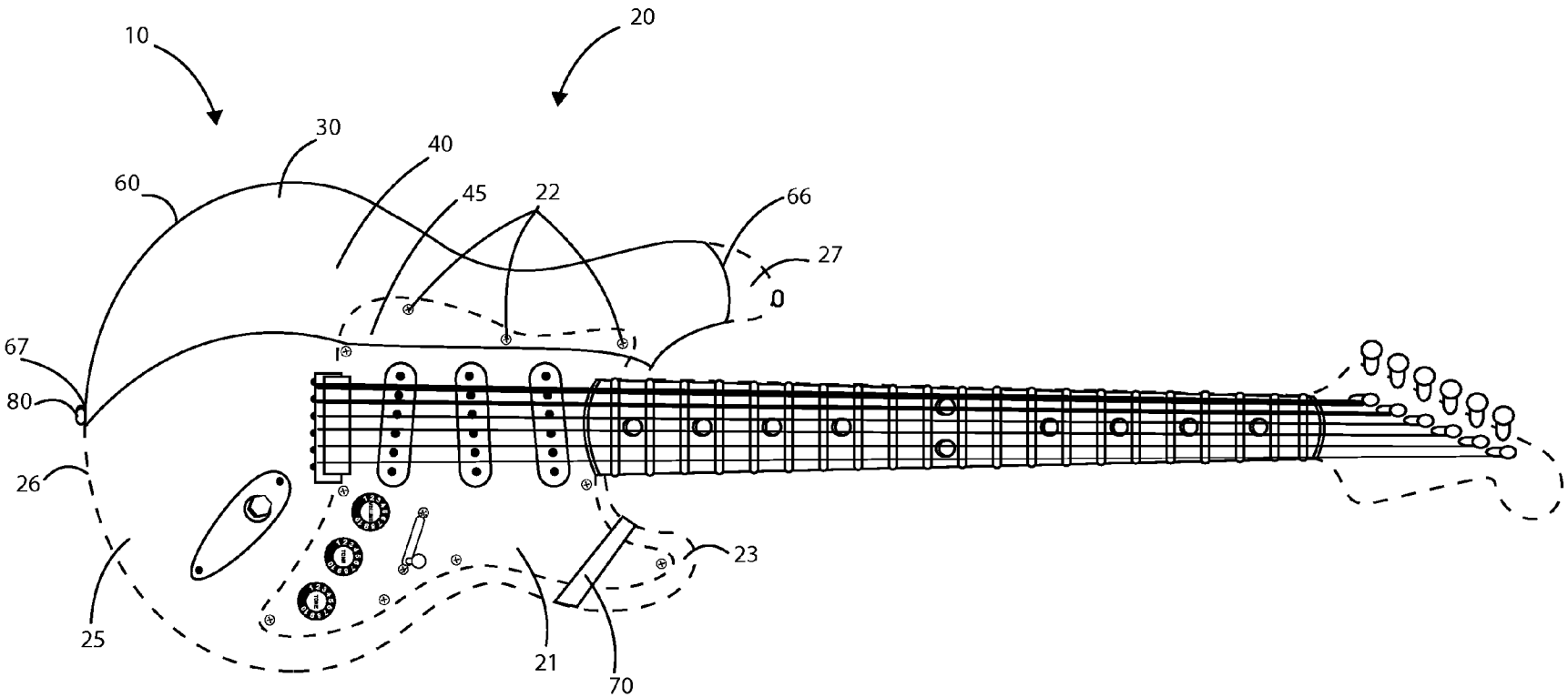
FIG. 5 illustrates another front view of the guitar with the protective cover secured to the front of the guitar with a pick guard and pick guard screws.

Referring to FIG. 5, a protective cover 10 comprising a U-shaped cradle 30 is illustrated in accordance with a feature of the present invention and includes a flexible front member 40, an edge member 60, a back member 50 and a flexible loop 70 that can be fixed to the front side 25 of the guitar having a pick guard 21 fastened to the front side 25 with pick guard screws 22. The pick guard engagement portion 45 can be shaped to allow placement of the protective cover 10 between the pick guard 21 and the front side 25 of the guitar 20. The pick guard screws 22 can transverse the pick guard engagement portion 45 to better retain the cover 10 onto the guitar surface 25. An aperture 67 on the edge member 60 of the cover 10 can receive the strap button 80 on the peripheral edge 26 of the guitar 20.

Figure 6:
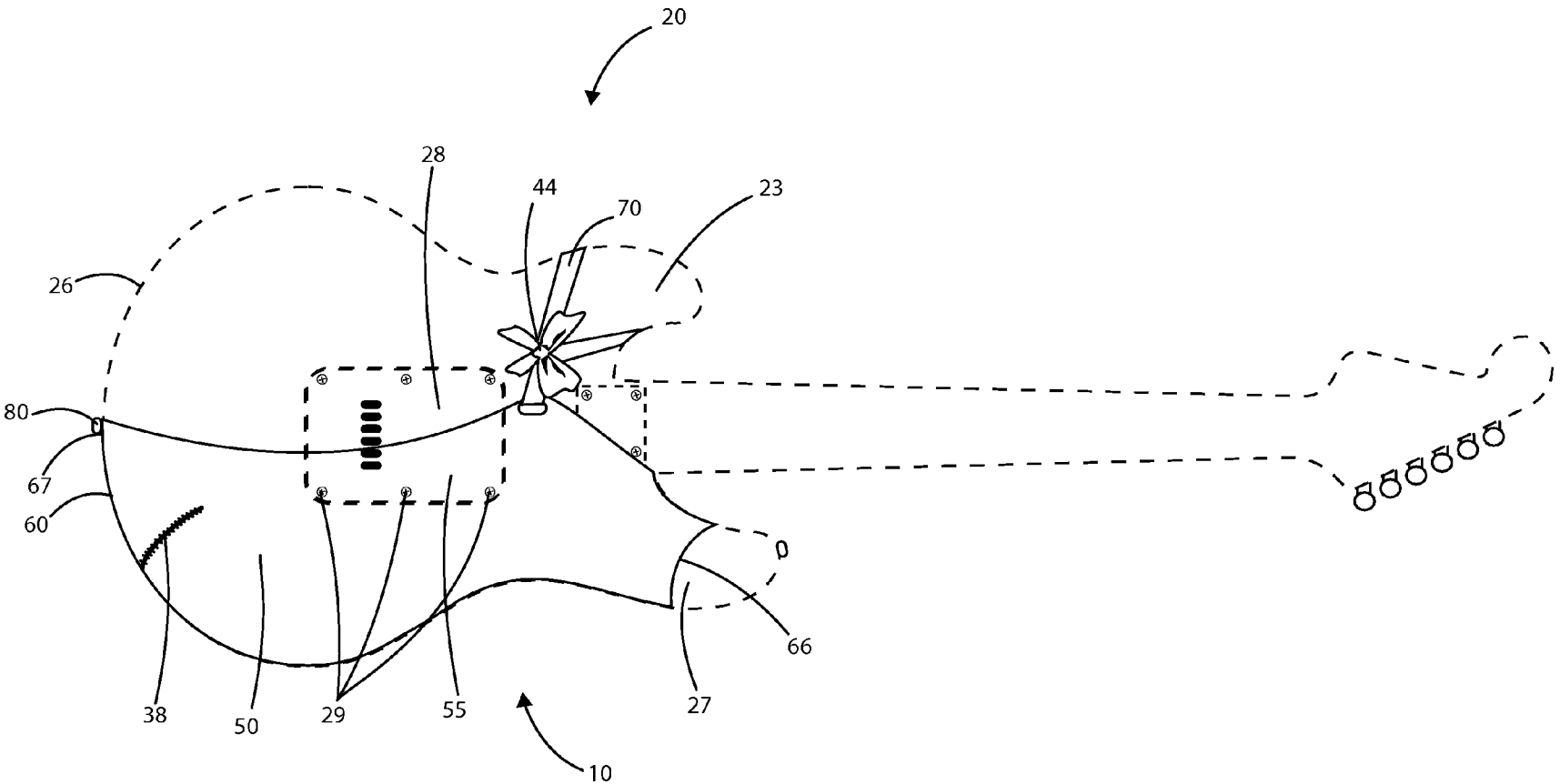
FIG. 6 illustrates another back view of the guitar with the protective cover held in place on the back of the guitar by a back plate and back plate screws.

Referring to FIG. 6, the protective cover 10 is illustrated to be pulled tight behind the black plate 28 located on the back surface 23 of the guitar 20. The back member 50 of the cover can include a back plate engagement portion 55 shaped to allow the cover 10 to be located between the back plate 28 and the back side of the guitar. Back plate screws 29 can transverse the back plate engagement portion 55 to further retain the cover 10 onto the guitar 20. The rear seam 38 on the back member 50 can be sewn by means of a suitable sewing thread. The flexible loop 70 can be fastened 44 at the back side of the guitar 20.

Figure 7:
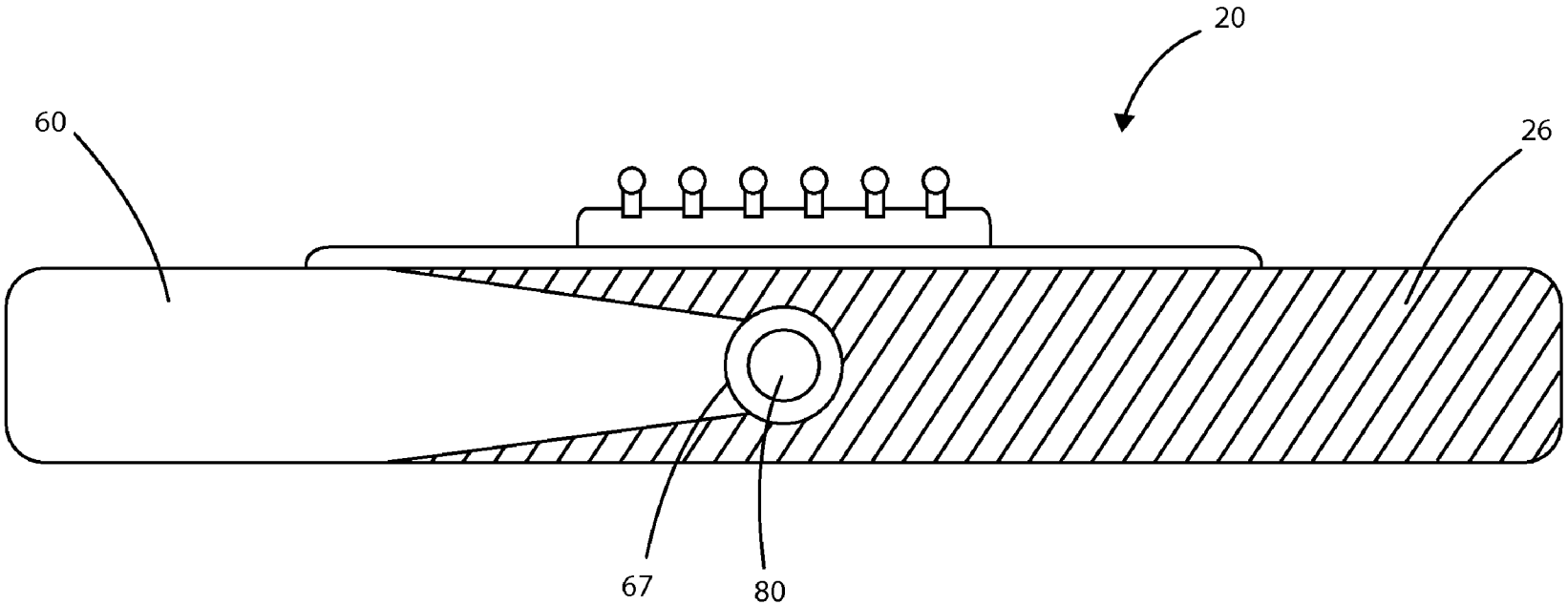
FIG. 7 illustrates the rear edge view of the guitar with the protective cover in place along the peripheral edge of the guitar and its aperture receiving a strap button.

Referring to FIG. 7, an edge view of the guitar 20 is illustrated wherein a strap button 80 is shown to be installed on the peripheral edge 26 of the guitar 20. The flexible edge member 60 of the cover 10 includes an aperture 67 for receiving the strap button 80 to retain the cover 10 onto the guitar 20.

Figure 8:
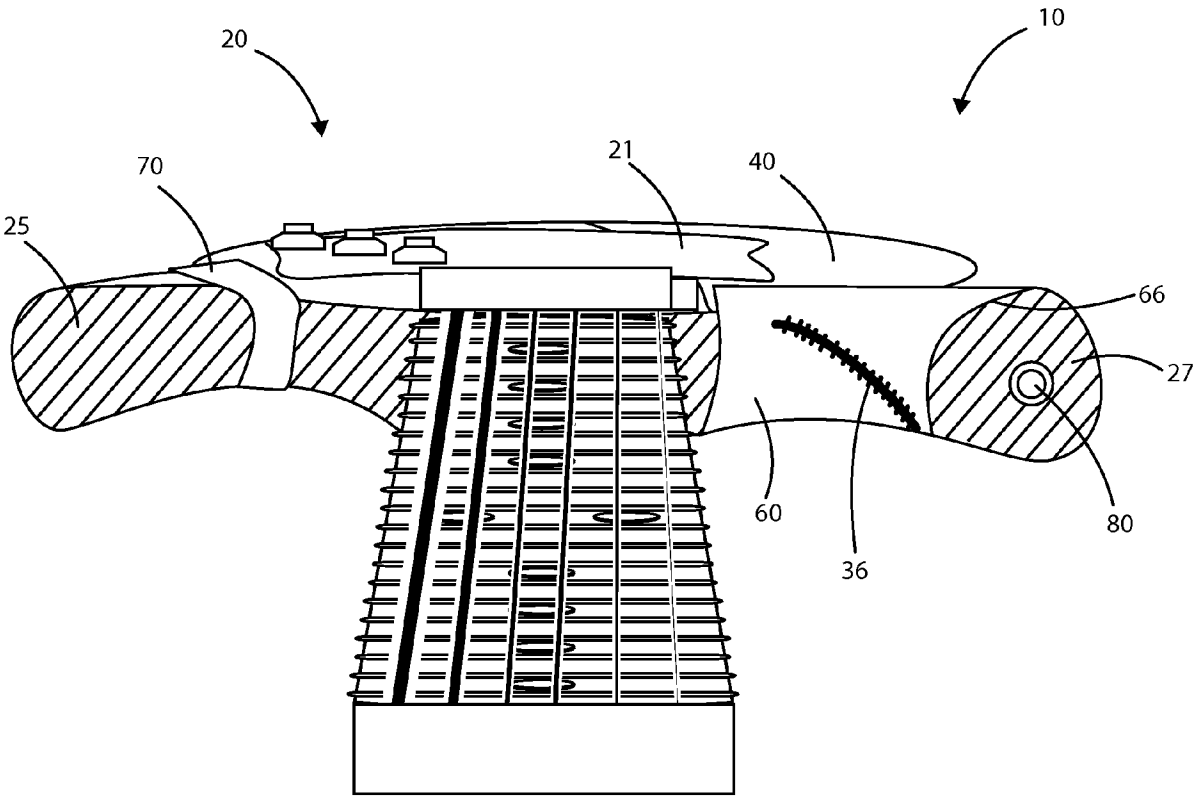
FIG. 8 illustrates a top view of the guitar with the protective cover in place over the guitar's body.

Referring to FIG. 8, a top edge illustration of the guitar 20 is shown looking towards its body 25. The protective cover 10 includes a flexible front member 40, flexible edge member 60, and flexible loop 70 attachable to the back member 50 (not shown). A strap button 80 is shown as it would be normally located on the upper fin 27 to also help secure a shoulder strap (not shown). A seam 26 is shown on the flexible edge member 60, and can also facilitate use or installation of the protective cover 10.

Figure 9:
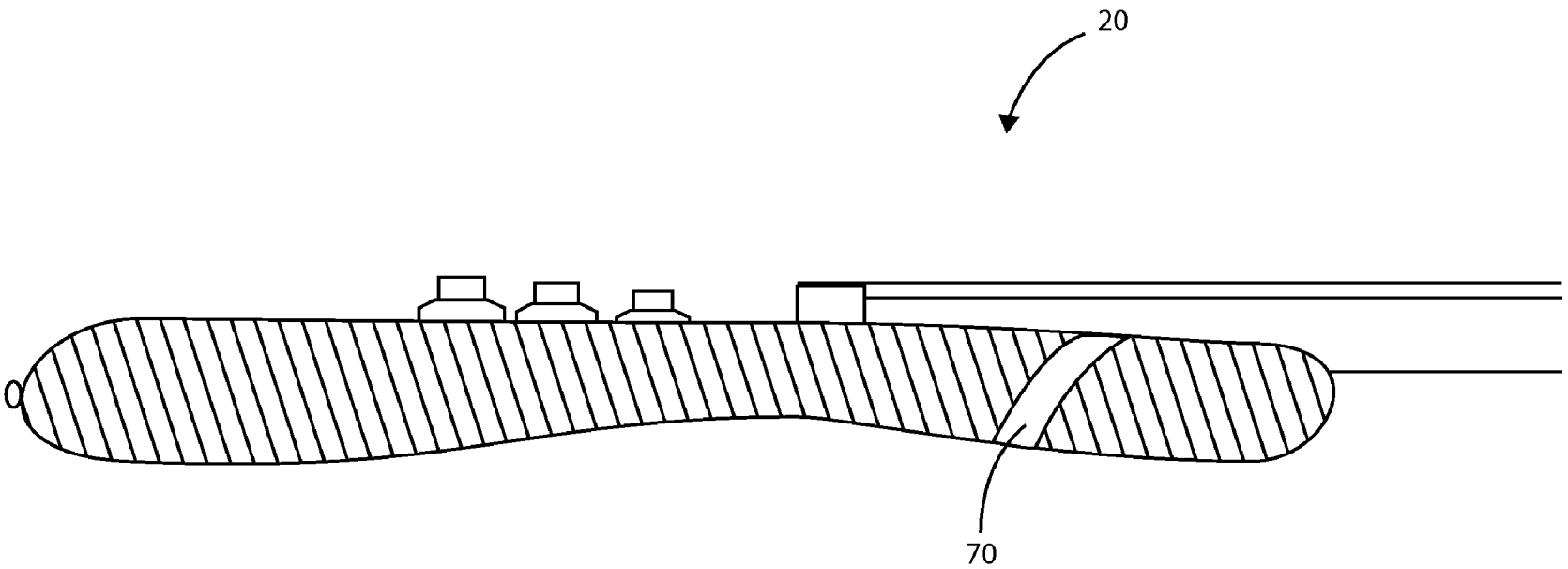
FIG. 9 illustrates a lower edge view of the guitar along its side with the flexible loop of the protective cover in place over the lower fin.
Figure 10:
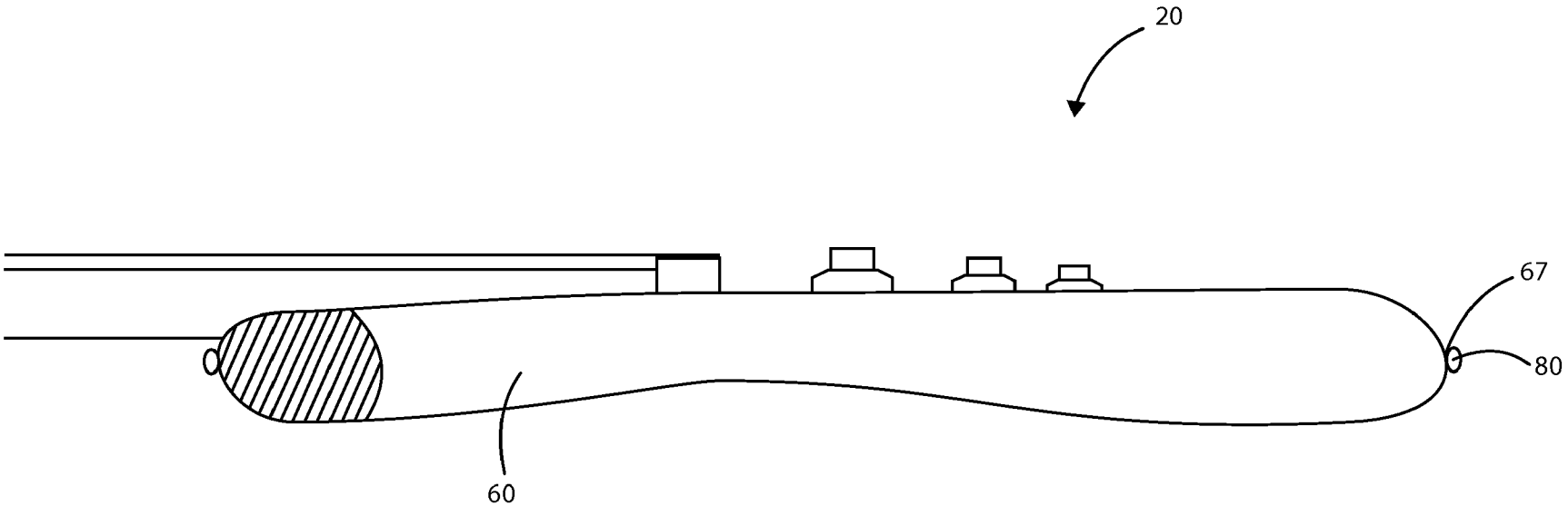
FIG. 10 illustrates an upper side view of the guitar along its side with the protective cover stretched around the peripheral edge of the guitar along its side.

Referring to FIG. 9, a lower view of the guitar 20 on its side is illustrated with the flexible loop 70 of the protective cover 10 (not shown) located in its place around the fin. Referring to FIG. 10, a side top view of the guitar 20 is shown with an outer edge 40 of the protective cover shown stretched over the guitar's edge. The protective cover 10 can be pulled over the guitar 20 and an aperture 67 on the edge member 40 of the cover 10 can be fitted over the strap button 80 as displayed in the illustration.

Use of the protective cover 10 can be described as follows. The upper fin engaging portion 65 of the edge member 60 fits over the upper fin 27 of the guitar 20. The cover can then be pulled to the rear of the guitar 20 where the aperture on the edge member 60 of the cover 10 fits over the strap button retaining the cover 10 onto the guitar 20. In the front side of the guitar 20 four upper pick guard screws 22 can be removed from the pick guard 21. The pick guard engagement portion 45 of the cover 10 can be pulled tight behind the pick guard 21 and the front side 24 of the guitar. The pick guard screws 22 traversing the pick guard engagement portion 45 can be used to fasten the cover 10 onto the guitar 20. Three back plate screws 29 can then be removed and back plate engagement portion 55 of the cover 10 can be pulled tight between the back plate 28 and the back side of the body 25 of the guitar 20. The three back plate screws 29 then transverse the back plate engagement portion 55 to further retain the cover 10 on to the guitar 20. A flexible loop 70 can then be pulled down across the rear of the instrument and loops around the lower fin 23 and fastens 44 on the posterior side of the guitar 20 to hold the U-shaped cradle 30 to the guitar.

While a particular form of the invention has been illustrated and described, it will be apparent that various modifications can be made without departing from the spirit and scope of the invention. For example, the protective cover 10 can potentially be manufactured in an array of styles including various colors and patterns, assorted materials such as light-weight leather, and adorned with studs or decals, or formed with cutout patterns. Accordingly, this description is not intended to limit the scope of the present invention. The scope of the invention can only be interpreted using the appended claims.

What is claimed is:

1. A protective cover for a guitar of the type having a body with an upper fin and a lower fin, the cover comprising:

a generally U-shaped cradle having a flexible front member connected to a flexible back member by a flexible edge member, an upper fin-engaging portion of the edge member configured into a sleeve and adapted to fit over the upper fin of the guitar; and a flexible loop attached to the back member, the loop adapted to surround the lower fin of the guitar to hold the generally U-shaped cradle to the guitar.

2. The protective cover of claim 1 wherein the guitar is of the type having a pick guard fixed to a front side of the guitar with pick guard screws, the front member of the cover further including a pick guard engagement portion shaped to allow placement thereof between the pick guard and the front side of the guitar, the pick guard screws traversing the pick guard engagement portion to further retain the cover onto the guitar.

3. The protective cover of claim 1 wherein the guitar is of the type having a back plate fixed to a back side of the guitar with back plate screws, the back member of the cover further including a back plate engagement portion shaped to allow placement thereof between the back plate and the back side of the guitar, the back plate screws traversing the back plate engagement portion to further retain the cover onto the guitar.

4. The protective cover of claim 1 wherein the guitar is of the type having a strap button on a peripheral edge thereof, the edge member of the cover further including an aperture for receiving the strap button therein to further retain the cover onto the guitar.

5. The protective cover of claim 1 wherein the flexible front member, back member, and edge member are each made from an elastic lycra material.

6. The protective cover of claim 1 wherein the flexible loop is made from a flexible elastic material.

7. The protective cover of claim 1 wherein the upper fin-engaging portion of the edge member includes a fin aperture therein such that the upper fin of the guitar projects therethrough when the cover is fitted onto the guitar.

8. The protective cover of claim 1 wherein the flexible front member, back member, and edge members are each made from leather.

9. The protective cover of claim 1 wherein the flexible front member, back member, and edge members are integrally formed from a common web of flexible material.

10. A protective cover for an electric string instrument of the type having a body with an upper fin and a lower fin, the cover comprising:

a generally U-shaped cradle having a flexible front member connected to a flexible back member by a flexible edge member, an upper fin-engaging portion of the edge member configured into a sleeve and adapted to fit over the upper fin of the electric string instrument; and a flexible loop attached to the back member, the loop adapted to surround the lower fin of the electric string instrument to hold the generally U-shaped cradle to the electric string instrument.

11. The protective cover of claim 10 wherein the electric string instrument is of the type having a pick guard fixed to a front side of the guitar with pick guard screws, the front member of the cover further including a pick guard engagement portion shaped to allow placement thereof between the pick guard and the front side of the electric string instrument, the pick guard screws traversing the pick guard engagement portion to further retain the cover onto the electric string instrument.

12. The protective cover of claim 10 wherein the electric string instrument is of the type having a back plate fixed to a back side of the electric string instrument with back plate screws, the back member of the cover further including a back plate engagement portion shaped to allow placement thereof between the back plate and the back side of the electric string instrument, the back plate screws traversing the back plate engagement portion to further retain the cover onto the electric string instrument.

13. The protective cover of claim 10 wherein the electric string instrument is of the type having a strap button on a peripheral edge thereof, the edge member of the cover further including an aperture for receiving the strap button therein to further retain the cover onto the electric string instrument.

14. The protective cover of claim 10 wherein the flexible front member, back member, and edge member are each made from an elastic lycra material.

15. The protective cover of claim 10 wherein the flexible loop is made from a flexible elastic material.

16. The protective cover of claim 10 wherein the upper fin-engaging portion of the edge member includes a fin aperture therein such that the upper fin of the electric string instrument projects therethrough when the cover is fitted onto the electric string instrument.

17. The protective cover of claim 10 wherein the flexible front member, back member, and edge members are each made from leather.

18. The protective cover of claim 10 wherein the flexible front member, back member, and edge members are integrally formed from a common web of flexible material.

19. The protective cover of claim 10 wherein the electrical string instrument covered by the protective cover is an electric guitar.

20. The protective cover of claim 10 wherein the electrical string instrument covered by the protective cover is an electric bass.

* * * * *